US008043095B2

(12) United States Patent
Dennes et al.

(10) Patent No.: US 8,043,095 B2
(45) Date of Patent: Oct. 25, 2011

(54) PLUG-IN CONNECTOR FOR A CONNECTOR-ENDED CABLE

(75) Inventors: Wayne Dennes, Wyoming (AU); Michael Sielaff, Killarney Vale (AU)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 11/753,369

(22) Filed: May 24, 2007

(65) Prior Publication Data

US 2008/0254672 A1 Oct. 16, 2008

Related U.S. Application Data

(62) Division of application No. 10/521,878, filed as application No. PCT/EP03/07675 on Jul. 16, 2003, now Pat. No. 7,232,331.

(51) Int. Cl.
*H01R 4/04* (2006.01)

(52) U.S. Cl. ..... 439/55; 439/395; 439/404; 439/931

(58) Field of Classification Search ..... 439/55, 439/395, 404, 931
See application file for complete search history.

(56) References Cited

U.S. PATENT DOCUMENTS

| | | | | |
|---|---|---|---|---|
| 3,390,375 | A | 6/1968 | Salmonson | |
| 4,973,262 | A | 11/1990 | Gerke et al. | |
| 5,609,499 | A | 3/1997 | Tan et al. | |
| 5,749,746 | A | 5/1998 | Tan et al. | |
| 5,997,311 | A | 12/1999 | Crouse et al. | |
| 6,159,020 | A | 12/2000 | Baker et al. | |
| 6,193,568 | B1 * | 2/2001 | Dorr | 439/876 |
| 6,227,886 | B1 | 5/2001 | Baker et al. | |
| 6,346,005 | B1 | 2/2002 | Viklund et al. | |
| 6,494,739 | B1 * | 12/2002 | Vivenzio et al. | 439/579 |
| 6,997,762 | B2 * | 2/2006 | Smith | 439/66 |
| 7,025,622 | B2 * | 4/2006 | Leitl et al. | 439/412 |
| 7,232,331 | B2 * | 6/2007 | Dennes et al. | 439/404 |
| 2001/0024904 | A1 | 9/2001 | Fischer | |

FOREIGN PATENT DOCUMENTS

| | | |
|---|---|---|
| DE | 100 51 097 | 3/2002 |
| GB | 2 375 437 | 11/2002 |
| TW | 291202 | 5/2006 |
| WO | WO 01/11731 | 2/2001 |

* cited by examiner

*Primary Examiner* — Gary F. Paumen

(74) *Attorney, Agent, or Firm* — Merchant & Gould P.C.

(57) ABSTRACT

An electrical connector (10) having a contact element (50) retained in a hollow body (12.) The body (12) has an internal socket structure (44) for receiving an end of the contact element (50) so that insulation displacement contacts (54) of this engage and make electrical connection to wires (70) of an incoming cable (16) to which the connector is connected. Fingers (56) of the connector element (50) extend externally of the connector body and carry electrical contacts (82).

6 Claims, 9 Drawing Sheets

PLUG-IN CONNECTOR FOR A CONNECTOR-ENDED CABLE

This application is a Divisional application Ser. No. 10/521,878, filed Oct. 14, 2005, which is the National Stage of Application PCT/EP2003/007675, filed Jul. 16, 2003 and which application(s) are incorporated herein by reference.

This invention relates to an electrical connector, an electrical connector element and to a deflector element forms part of or for use with an electrical connector.

U.S. Pat. No. 6,159,020 describes an electrical connector having a hinged portion which is movable from a position at which access to electrical contacts of the connector may be had and another position which it facilitates pulling of the connector and an attached flexible cable through a space occupied by numerous wires. When in the latter position, the hinged portion presents a sloping surface which deflects wiring as the connector is pulled through the space to prevent fouling of the wiring by the connector. While this arrangement is reasonably effective in use, it is relatively complex to manufacture products with hinged parts.

In one aspect, the invention provides a deflector element for use with an electrical connector attachable to an electrical cable, the deflector element having a deflector surface and being attachable to the cable when used with said connector, so as to be slidable on the cable to a first position adjacent the connector such that the deflector surface is angularly disposed with respect to the direction of extent of the cable so as to converge towards the cable away from the connector, for deflecting electric cabling around the connector when the connector is by pulling of the lead moved through interstices in electric cabling, and being slidable to a second position on the cable so as to be spaced away from the connector. At the second position, the deflector element may allow access to electrical contacts of the connector.

The invention also provides an electrical connector having a deflector element as above described.

Electrical contacts of an electrical connector for making external connections to the 30 connector may be carried by an insulative body of the connector. Internal connections between the electrical contacts and electric conductors to the contacts may be made in any suitable way, such as crimping the conductors to the connectors. Particularly where the external contacts are internal of the connector, but remote from the location at which conductors extend into the connector, separate internal conductive elements may be provided in the connector to provide connections between the conductors and the contacts. Positioning of these elements, and the conductors, in the connector, during manufacture, may be difficult, particularly where the contacts are in a relatively inaccessible part of the connector interior.

In one aspect, there is provided an electrical connector element having a plurality of insulation displacement contacts, and a plurality of electrical contacts, the insulation displacement contacts and the electrical contacts being interconnected by electrical conductors, the connector element being receivable in a socket structure of a connector body of an electrical connector such that the insulation displacement contacts displace electrical insulation of insulated wires received by the connector body to establish electrical connection between electrical conductors of the wires and the insulation displacement contacts. This connector element may simplify coupling of the electrical contacts to wires leading to the connector.

The connector element may be formed by a laminar insulative substrate which carries the insulation displacement contacts.

The connector element is particularly useful in forming a connector where the externally accessible contacts are positioned in a part of the connector which is remote from and generally parallel to a part of the incoming electrical cable when receiving the connector. Thus, in a particular form, the invention provides an electrical connector having a first portion which has a cable receiving portion, for receiving an end portion of an electrical cable, so that the cable extends away from the first portion, at a first side thereof, in a direction transverse to the first portion, and insulated wires of the cable are received by the first portion, said first portion having, at a location spaced from the cable receiving portion, mounting structure which receives a first end portion of a connector element, such that insulation displacement contacts of the connector element receive and make electrical contact with said wires, said connector element having, at a second end portion opposite said first end portion, electrical contacts for making electrical connection to electrical contact members of a mating connector device, said connector element extending from said first portion of the connector at said first side thereof, so as to be generally parallel to said transverse direction.

In one form, the connector is arranged for mating assembly to a said connector device in the form of a connector module having openings for receiving said electrical contacts; said electrical connector, when assembled to the connector module, being arranged with said side of the first portion adjacent to and extending transversely over part of the module adjacent said openings, and with the connector element extending therefrom into the module so that said electrical contacts of the connector engage with the contact members of the module, and with said cable receiving portion positioned for receiving the cable such that it extends from the first portion adjacent a side of the module.

The invention also provides an electrical connector and cable, the connector having a first portion which has a cable receiving part, receiving an end portion of the cable, so that the cable extends away from the first portion, at a first side thereof, in a direction transverse to the first portion, and insulated wires of the cable are received by the first portion, said first portion having, at a location spaced from the cable receiving portion, mounting structure which receives an end portion of a connector element, such that insulation displacement contacts of the connector element receive and make electrical contact with said wires, said connector element having, at an end portion opposite said first end portion, electrical contacts for making electrical connection to electrical contact means of a mating connector device, said connector element extending from said first portion of the connector at said first side thereof, so as to be generally parallel to said transverse direction.

The invention still further provides an insulation displacement contact having structure defining a slot, formed between two spaced opposed portions of the structure, for receiving an insulated wire, by lateral movement of the wire, so that the wire is gripped between the opposed portions, and insulation of the wire is displaced by engagement with at least one of the opposed portions so that electrical connection is established between an inner conductor of the insulated wire and said at least one opposed portion, wherein the opposed portions are formed from insulative material, a conductive edge portion being disposed on the insulative material at said at least one opposed portion at a location thereof for making said electrical connection.

Preferably, said conductive edge portion is disposed on the insulative material at said at least one opposed portion at an edge surface thereof defining a side of the slot.

Preferably, the insulation displacement contact is arranged for displacement of the wire insulation by engagement with both of the opposed portions, a conductive edge portion being disposed on the insulative material at the other of said opposed portions, for establishing electrical connection between said inner conductor and the other said opposed portion.

Preferably, the conductive edge portion is disposed on said at least one opposed portion at least one opposed portion at an edge surface thereof defining a side of the slot.

Preferably, the conductive edge portions on the insulative material, at each said opposed portion are disposed at edge surfaces of the opposed portions which surfaces define respective sides of the slot.

Preferably, the structure is formed from a laminar insulative substrate to which the or each said conductive edge portion is applied.

The insulation displacement contact may be in the form of a printed circuit board, conductive tracks being formed on the printed circuit board and electrically coupled to the or each said conductive edge portion.

The invention also provides an electrical connector from a hollow body and a portion for receiving a connector element having insulation displacement contacts at one end electrically coupled to contacts on fingers at the other end, the fingers extending from openings in the hollow body, the body being in two parts, one having said openings and an entry passageway for an electrical cable having insulated wires, and the other having a socket structure for receiving said one end of said connector element, and said wires, the method including the steps of:

(a) passing said wires through said entry passageway and arranging them to be received at said socket structure, (b) assembling said connector element so that said one end is received and retained in said socket structure such that insulation of the wires is displaced by said insulation displacement contacts to establish electrical connection to conductors of the wires and thus to the finger contacts, (c) assembling the body parts so that the connector element is retained in said body with said fingers extending externally thereof, and said finger contacts are positioned externally.

The invention further provides an electrical connector having a hollow body receiving a connector element having insulation displacement contacts at one end electrically coupled to contacts on fingers at the other end, the fingers extending from openings in the hollow body, the body being in two parts, one having said openings and an entry passageway for an electrical cable having insulated wires and the other having a socket structure, said wires passing through said entry passageway and being received at said socket structure, said connector element at said one end being received and retained in said socket structure such that insulation of the wires is displaced by said insulation displacement contacts to establish electrical connection to conductors of the wires and to the finger contacts, the connector element being retained in said body with said fingers extending externally thereof, so that said finger contacts are positioned externally.

The invention is further described, by way of example only, with reference to the accompanying drawings, in which.

Figure 1:
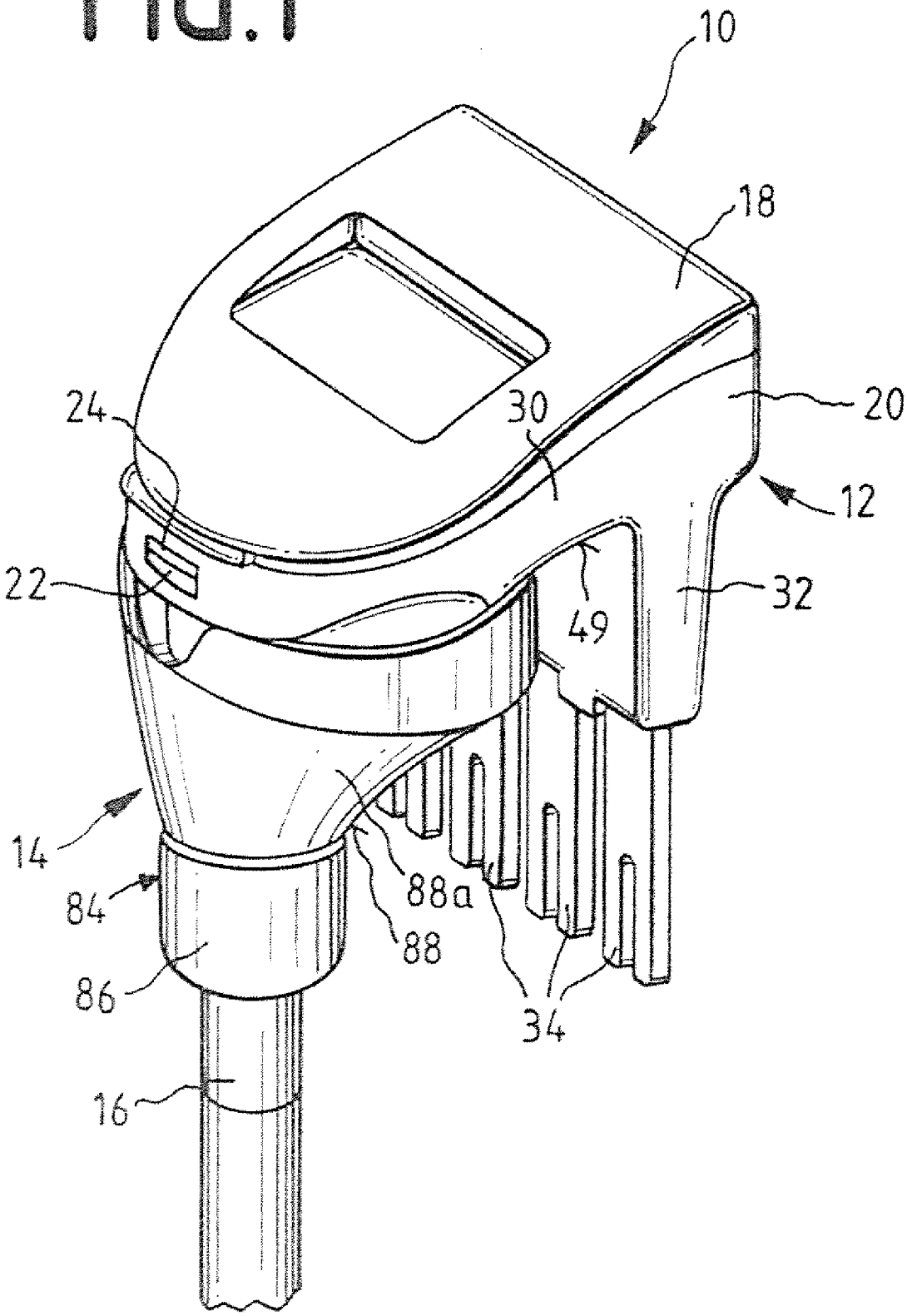
FIG. 1 is an upper side perspective view of an electrical connector constructed in accordance with the invention, a deflector element of the connector being shown in a position for use of the connector in making electrical connection to a mating component.
Figure 2:
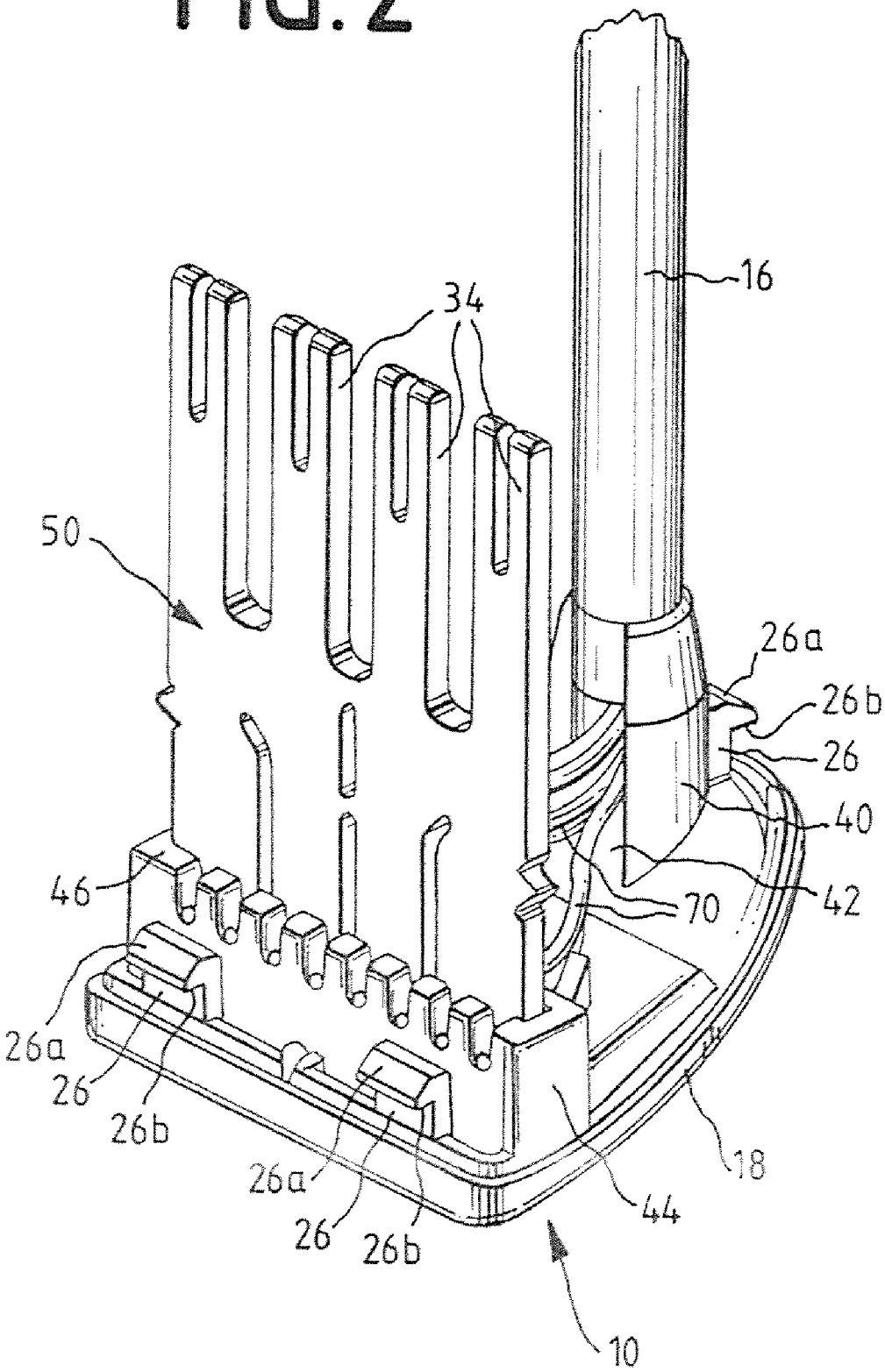
FIG. 2 is an underside view of an upper casing part of the connector of FIG. 1, an internal connector element of the connector, and an attached cable, the connector element being shown disassembled from the upper casing part.

The connector 10 shown in FIGS. 1 to 4 is designed to mate, in a manner described later, with connector module 100, shown in FIGS. 16 and 17.

Connector 10 has a hollow electrically insulative connector body 12, and a separately formed deflector element 14. The deflector element 14 is slidably retained on an electric cable 16 which is connected to the connector body 12.

Connector body 12 is formed in two parts, an upper part 18 and a lower part 20. These are coupled together by three snap fasteners 22, each comprising an aperture 24 and on body part 18, and a cooperating latching post 26 on body part 20. Posts 26 each have an inclined leading cam surface **26*a* for deflecting the post by camming action against edges of the aperture as the posts are passed into the apertures, after which the cam surfaces pass through the apertures to allow the posts to return to a substantially undeflected position at which release of the two parts 18, 20 is prevented by engagement of transverse locking surfaces 26*b* on the posts 26 with edges of the apertures 24**.

Figure 4:
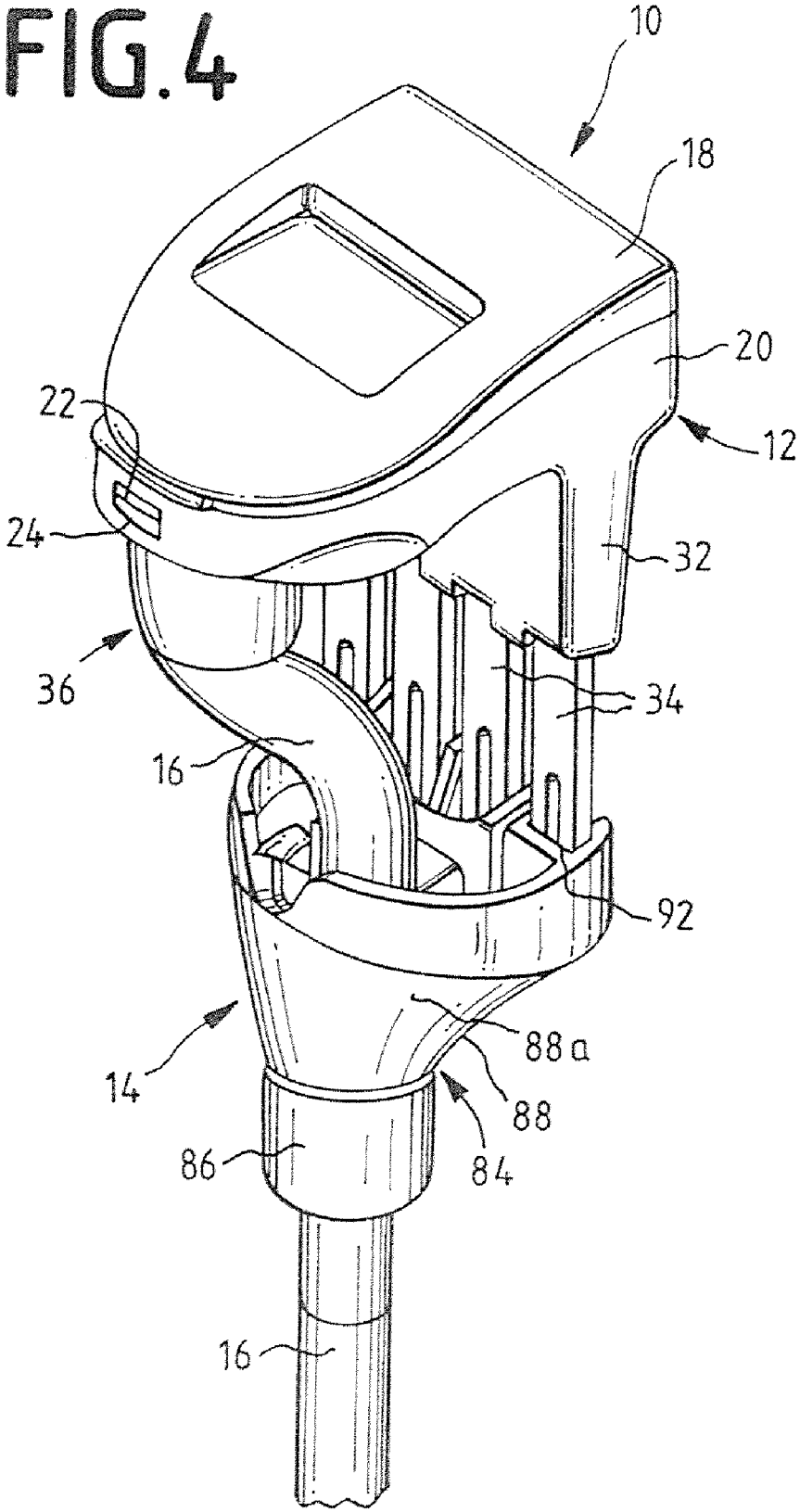
FIG. 4 is a perspective view like FIG. 1 but showing a deflector element of the connector in a position for use in which it facilitates pulling of the connector through interstices in a cable wiring space.
Figure 5:
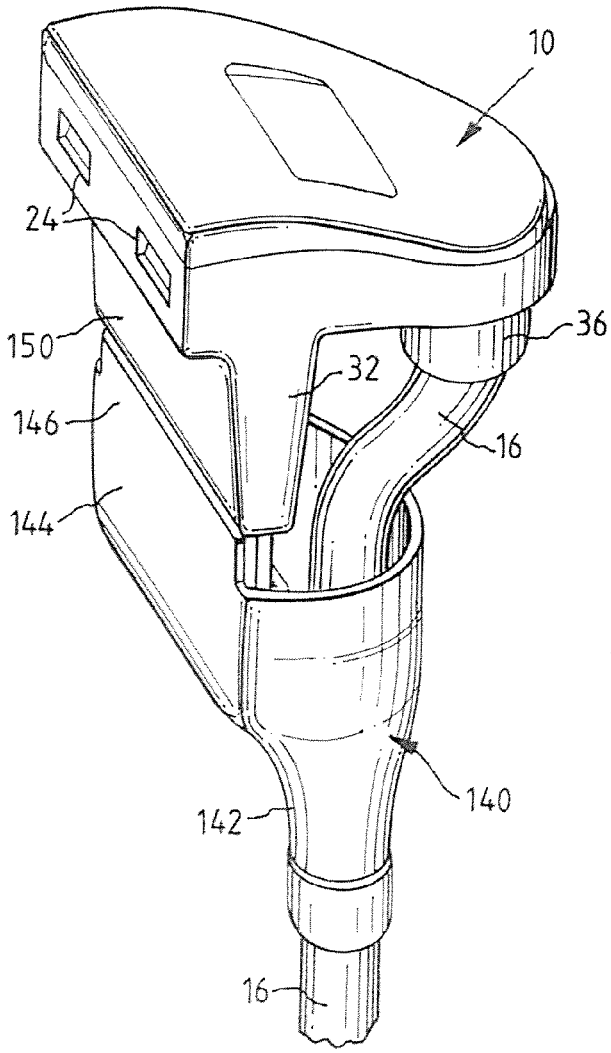
FIG. 5 is an opposite perspective view of the connector of FIG. 1 with a modified deflector element, in condition for use.
Figure 6:
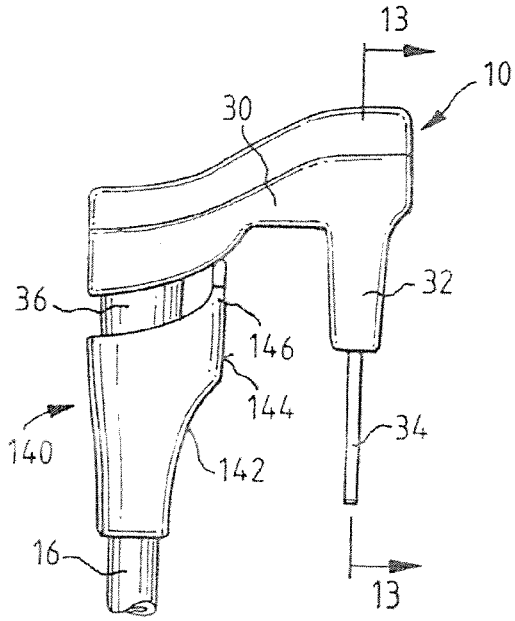
FIG. 6 is a side view of the connector and deflector element of FIG. 5.
Figure 7:
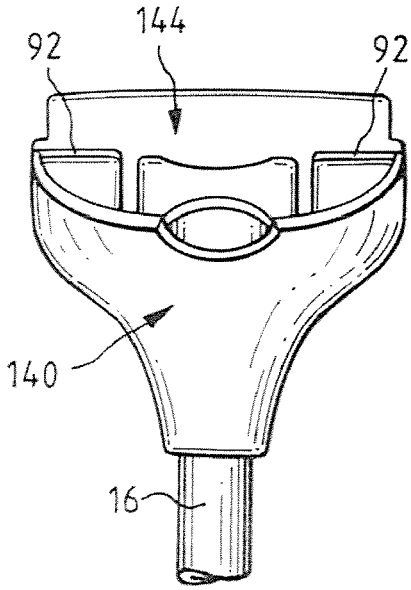
FIG. 7 is a front view of the deflector element shown in FIG. 5.
Figure 8:
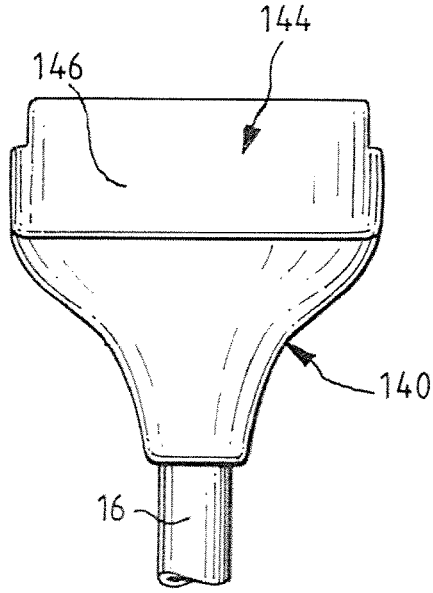
FIG. 8 is a rear view of the deflector element of FIG. 5.
Figure 9:
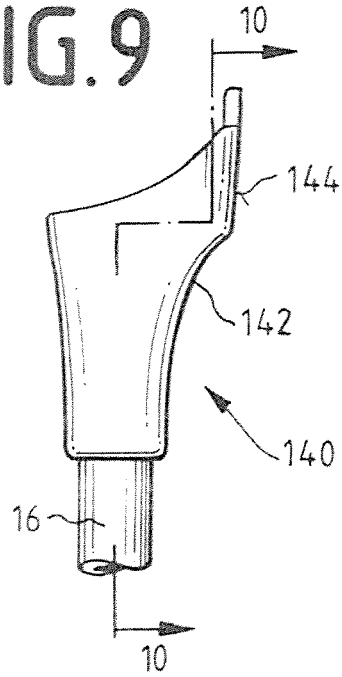
FIG. 9 is a side view of the deflector element of FIG. 5.
Figure 18:
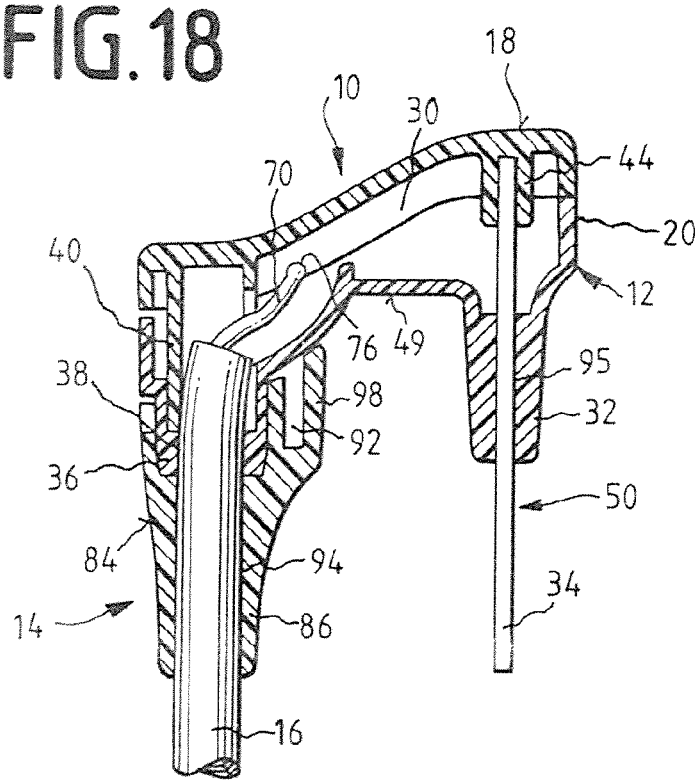
FIG. 18 is a vertical section of the connector of FIG. 1, and cooperating deflector element.

The connector body 12 generally defines a first bridging portion 30 having towards one end a downwardly depending portion 32 from which project contact portions 34 of connector 10. As best shown in FIG. 4, towards the end of the first portion 30 opposite portion 32, body 12 has a cable receiving portion 36 (FIG. 4) which is formed on lower body part 20 and which receives an end portion of cable 16 so that the cable extends into the interior of the connector body. Cable receiving portion 36 is in the form of a downwardly projecting spigot having a generally cylindrical passageway 38 therethrough (FIG. 18).

The lower body part 20 defines the depending portion 32, a lower part of the first portion 30 as well as the cable receiving portion 36 and the passageway 38. The body part 18 forms an upper closure for the connector body 12.

At an underside location, on part 18, there is an internal depending spigot 40 which fits into the upper part of the passageway 38. The cable 16 passes into the connector 10 at the underside, through the spigot 40. Insulated wires 70 of the cable 16 extend out of the spigot via a side slot 42 in the spigot and into the interior of body 12.

Figure 3:
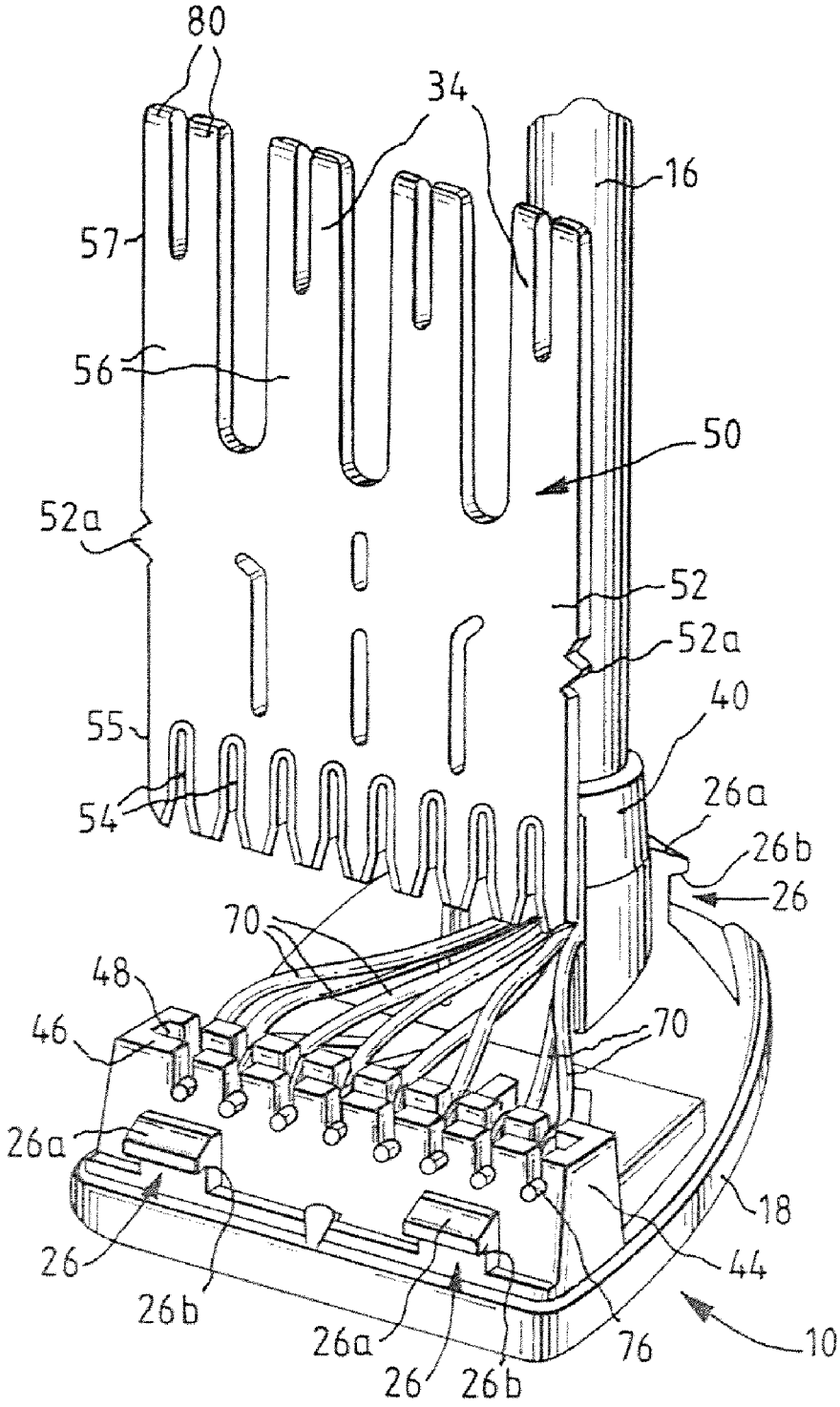
FIG. 3 is a view like FIG. 2, but showing the connector element assembled on the upper casing part.

As best shown in FIG. 3, the underside of part 18 has, at an end thereof opposite the spigot 40, a side-to-side extending socket structure 44. This depends downwardly from the underside of the part 18, and is formed as a rectangular wall 46 which defines therewithin an elongate rectangular socket 48. In the assembled connector 10, socket 48 extends internally across the connector body 12 immediately above the depending portion 32 of the connector body part 20.

As viewed from the side, connector body 12 has the cable 16 extending from a first side 49 adjacent one end and the portion 32 extending generally in parallel at the same side, but adjacent the opposite end of the body 12. The cable receiving portion 36 also extends from side 49 generally parallel to portion 32.

A connector element 50 of generally rectangular planar form has one end thereof accommodated within socket 48 and is frictionally retained therein. The connector element 50 is shown in more detail in FIGS. 11 and 12. It is formed as a printed circuit board having an insulative substrate 52 of generally rectangular configuration with conductive material thereon arranged to form components as next described. Particularly, at a first end portion 55 of the substrate which is received in the socket 48, the substrate has formed thereon insulation displacement contacts 54, arranged at the end edge of the substrate 52. At the opposite second end portion 57, the substrate 52 is formed with an array of fingers 56 which extend in spaced parallel relationship.

Figure 14:
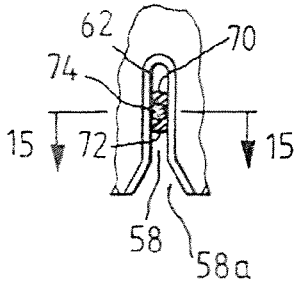
FIG. 14 is a fragmentary view of an end portion of the connector element of FIGS. 11 and 12, in position as shown in FIG. 2, in the region where it engages internal wires, viewed the direction rearwardly from a front major surface of the connector element as viewed in FIG. 2.
Figure 15:
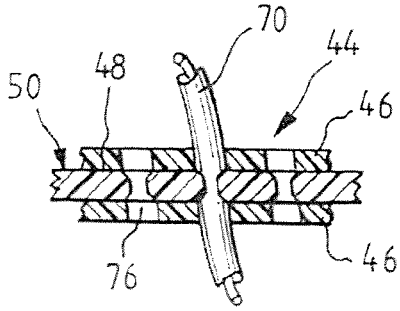
FIG. 15 is a fragmentary cross-section substantially on the line 15-15 in FIG. 14.

The IDCs 54 are formed by opposed portions 60 at the end of the substrate 52, adjacent pairs of which form separate ones of the IDCs. These portions 60 are in the form of outstanding tongues. Each IDC has an outwardly open slot 58 defined between the pair of opposed portions 60 which form that IDC. This forms a gap between portions 60. Edge surfaces of the slots 58 have electrically conductive edge portions 62. These are formed by any suitable way, such as used in forming printed circuit boards by conventional techniques. By pressing of an individual wire 70 of the cable 16 into an IDC slot 58, the insulation 72 surrounding the inner conductor 74 of the wire is cut by the edges of the IDC formed by the conductive edge portions 62 such that electrical connection is made between the conductive edge portions 62 and the inner conductor 74 (FIGS. 14 and 15). To facilitate entry of the wire into the IDCs, the slots 58 have outwardly tapered entry portions 58*a* which are wider at the edge of the substrate than at inner ends of the slots.

The socket structure 44 is configured to receive the wires 70 so that electrical connection is made between these and the IDCs 54, as at the end of the connector element 50 at which the IDCs are located is positioned in the socket 48 of the socket structure 44. In particular, the wall 46 has, in portions thereof at opposite sides of the connector element 50, notches 76 which are arranged at an angle of 45° with respect to the lengthwise direction of the socket structure 44. With the connector element 50 removed from the socket, the wires 70 are led from the cable 16, after this is passed into the connector 10 via cable receiving portion 36, so as to lie across the socket 48. Each wire 70 is thus received in two opposed notches 76 in the manner shown most particularly in FIG. 15. Pursuant to the angled alignment of the notches 76, the wires 70 thus lie at an angle to the direction of extent of socket 48. After this, the connector element 50 is placed in position and pressed downwardly into the socket 48 so that the IDCs 54 make connection with the wires 70 in the manner described above. The wires are then held in electrically conductive engagement with the insulation displacement contacts 54 by virtue of the connector element 50 being frictionally retained within the socket 48.

The fingers 56 of the connector element 50 have bifurcated free ends, each forming two spaced prongs 80. The prongs 80 have electrical contacts 82 therein, formed as conductive layers on opposite faces of the insulative substrate 52. Circuit tracks 78 on the printed circuit board, at either face, interconnect ones of the contacts 82 with ones of the insulation displacement contacts 54.

Figure 11:
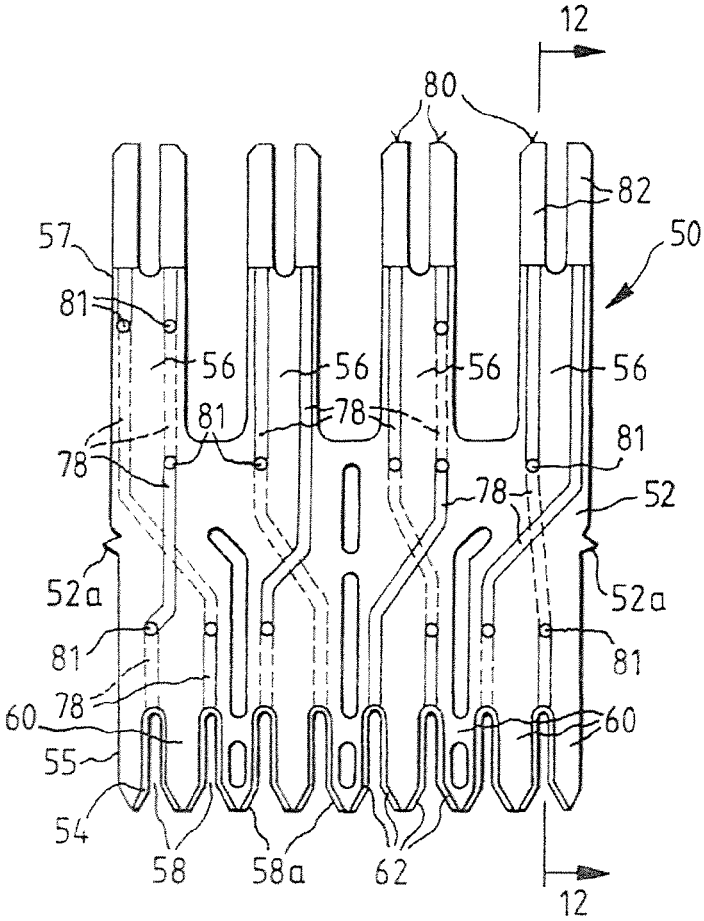
FIG. 11 is a front view of connector element incorporated into the connector of FIG. 1.
Figure 12:
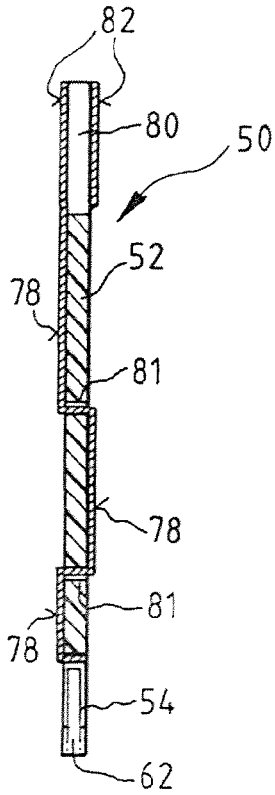
FIG. 12 is a cross-section on the line 12-12 in FIG. 11.

Contacts 82 are disposed two on each prong 80, one on the face of the substrate 52 shown in FIG. 11, and one on the obverse face. On the substrate 52, however, only one of each pair on a single prong 80 is connected to a track 78, in each case being the contact on the face shown in FIG. 11. The conductive tracks 78 are partly formed on the face of the substrate 52 shown in FIG. 11 and partly on the face. Parts of the tracks on the obverse face are shown in broken lines. Connections between parts of the tracks at either side are made by annular conductive portions 81 on the surfaces of through holes through the substrate. The arrangement results in crossings of tracks 78, between adjacent pairs thereof. This may assist in reduction of crosstalk in signals passing on the tracks 78.

Figure 13:
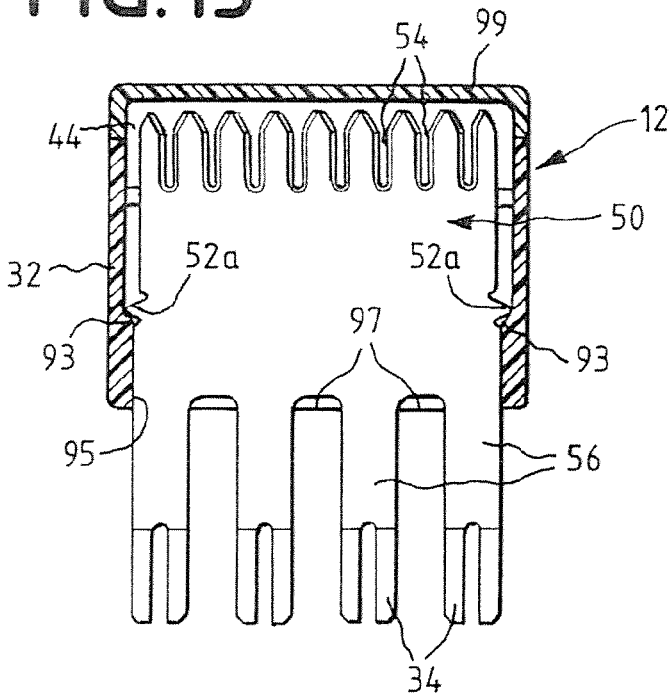
FIG. 13 is a cross-section substantially on the line 13-13 in FIG. 6.

In the assembled connector 10, the connector element 50 extends downwardly within connector body 12 from socket structure 44 into downwardly depending portion 32 of body 12 so that the fingers 56 project downwardly through openings 95 in a lower end wall 97 of body portion 32 (FIGS. 13 and 18). The so projecting portions of the fingers 56 form the contact portions 34 of connector 10.

As best shown in FIG. 18, the connector element 50 is retained in position by engagement at end portion 55 by the socket structure 44 and by engagement of inward steps 52*a* on substrate 52 with ledges 93 formed on the internal side walls of the connector body 12. By this arrangement, assembly of the connector 10 is relatively simple. For example, cable 16 may first be passed through deflector element 14, thence through passageway 38 in cable receiving portion 36 of body part 20, and into spigot 40. End portions of wires 70 from the cable 16 may then be laid into the notches 76 on socket structure 44, as shown in FIG. 3. Then, the connector element 50 may be assembled to the socket structure and upper body part 18. After that, assembly may be completed by passing the fingers 56 through the openings 95 of body part 20, and the body parts 18, 20 snapped together by pressing towards each other such as to engage the snap fasteners 22. The assembly may be performed with the upper wall portion 99 of body part 18 (FIG. 13) facing downwards as shown in FIG. 3.

The deflector element 14 has a body 84 formed for example of plastics material. At one end, it has an entry portion 86 with a central passageway 94 therethrough, by which the cable 16 extends through the deflector element 14. From the portion 86, the body 84 extends upwardly as viewed in FIGS. 1 and 4 at an outwardly and upwardly divergent hollow portion 88. Portion 88 is of a somewhat conical form, but flat at one side.

Referring to FIG. 18, the passageway 94 is arranged to frictionally grip the cable 16 so that the deflector element 14 may be moved lengthwise on the cable, but still maintain a set position along the length of the cable due to frictional engagement therewith. In a position where the deflector element 14 is moved on the cable 16 so as to be close to the connector body 12, and the deflector element 14 is appropriately rotated on cable 16 (FIGS. 1 and 18) the cable receiving portion 36 is received in an enlarged upper end of passageway 94. In this condition, the portion 88 of the deflector element 14 encompasses the underside of the connector body 12 and a generally planar side surface 98 of the body 84 is in spaced parallel relationship to an inner planar surface 28 of body portion 32. The deflector element can however be moved away from this position downwardly on the cable as viewed in FIG. 1, and thence sidewardly, to the right as viewed in FIG. 1, under bending of the cable 16, so to pass below the lower end of the contact portions 34. It can then be moved upwardly to the position shown in FIG. 4 so that the contact portions 34 of the connector 10 are captured in upwardly open pockets 92 formed adjacent but inside the side surface 98 of the deflector element 14. By this, the portion 88 presents a sloping, somewhat conical deflector surface 88*a* around the contact portions 34.

With the element 14 positioned as shown in FIG. 4, the cable 16 may be used to pull the connector 10 through a space having numerous electrical wires without the connector being caught by the wires. As described, the portion 88 presents a smooth conical deflector surface 88*a* and, by this, as the cable and connector are so pulled through, wiring to either side of the connector 10 is either laterally pushed outwardly by camming action against surface 88*a* of the deflector element 14 or else, by similar camming action, the connector 10 itself and deflector element 14 are so moved sidewardly to enable the connector 10 and deflector element 14 to pass easily. It will be appreciated that, because the connector 10 and attached cable 16 otherwise, present a somewhat U-shaped configuration from one leg of which extends the cable 16, the connector may otherwise be easily fouled on surrounding wiring by being captured between the portion 32, or projecting contact portions 34, and the cable 16 or cable receiving portion 36. The deflector element 14 effectively bridges portion 32 and the cable and cable receiving portion 36.

Figure 17:
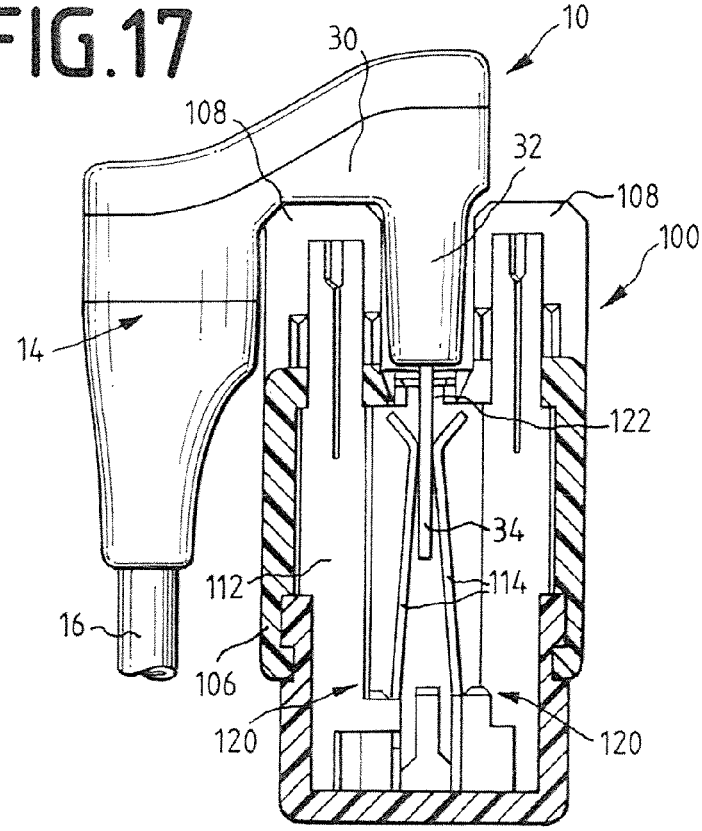
FIG. 17 is a transverse cross-section of the module and connector of FIG. 16, in the region where the connector interengages with the module.
Figure 16:
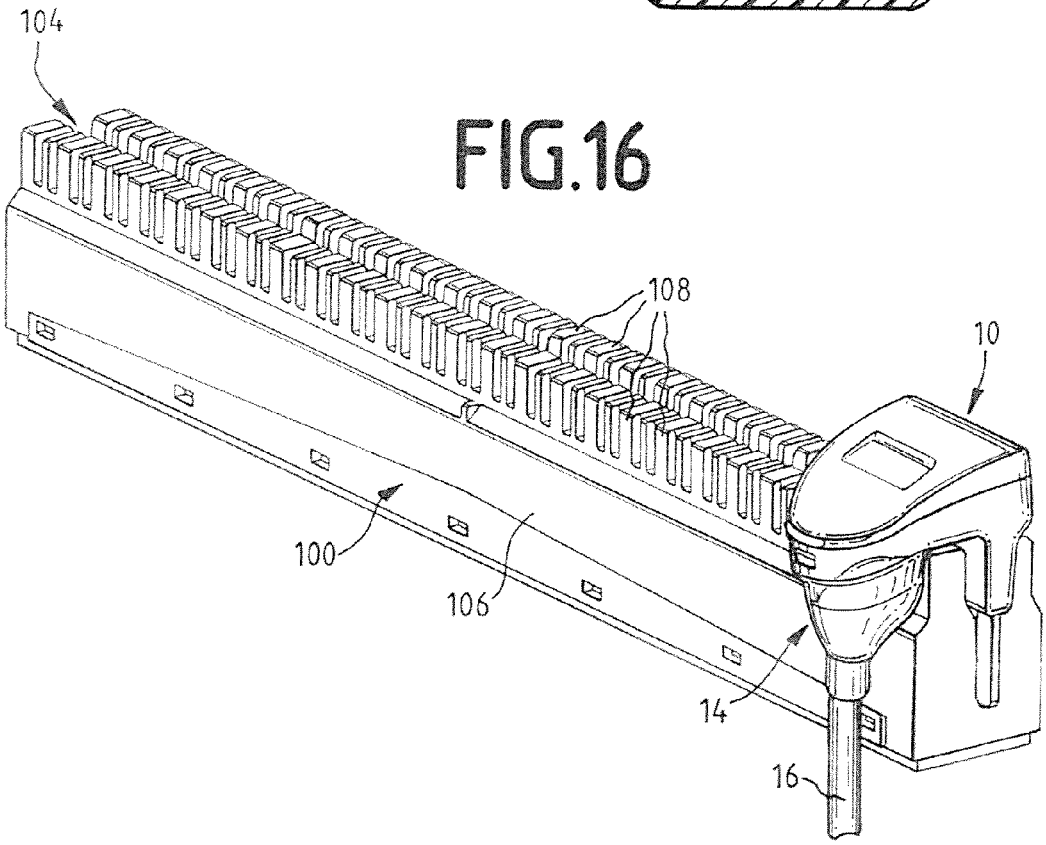
FIG. 16 is a perspective view of a connector formed in accordance with the invention, coupled to a connector module.

Referring particularly to FIGS. 16 and 17, the connector 10 is used to make connections to the module 100 by positioning it so that the portion 30 and projecting contact portions 34 extend to a central lengthwise extending trough 104 of the connector module, with the portion 30 extending sidewardly from the trough over the top of the module at one side, and with the cable 16 and deflector element 14 positioned adjacent an outer upright surface 106 of the module.

The trough 104 is defined between two opposed rows of upstanding posts 108 extending lengthwise along the upper part of the module. Between adjacent pairs of these are positioned insulation displacement contacts 112 (FIG. 17). These enable external connections to be made to the module by positioning wires (not shown) in these. The IDCs 112 are formed as parts of respective single contact members 120 which have, at locations underneath the trough 104, upstanding spring contact portions 114. Opposed associated IDCs 112 in each of the rows of these have contact portions 114 in adjacent relationship immediately below the trough 104. The associated pairs of the contact portions 114 may, for example, be normally engaged so as to interconnect associated contact members 120 across the rows or may be normally disconnected that is, not touching each other so as to isolate the associated contact members 120. In any event, the trough 104 has, in a lower portion thereof, openings 122 into which the contact portions 34 project when the connector 10 is positioned on the module 100 in the manner shown in FIGS. 16 and 17. The upper ends of the contact portions 114 are positioned so that these are displaced outwardly as a contact portion 34 enters between them, and such that they interconnect with respective ones of the contacts 82 of contact portions 34, across the module. Accordingly, when the connector 10 is so assembled onto the module 100, electrical connections are made from wires 70 of the cable 16 via the connector contact portions 34 to the contact members 120 of the module, via the contacts 82 and contact portions 114.

Figure 10:
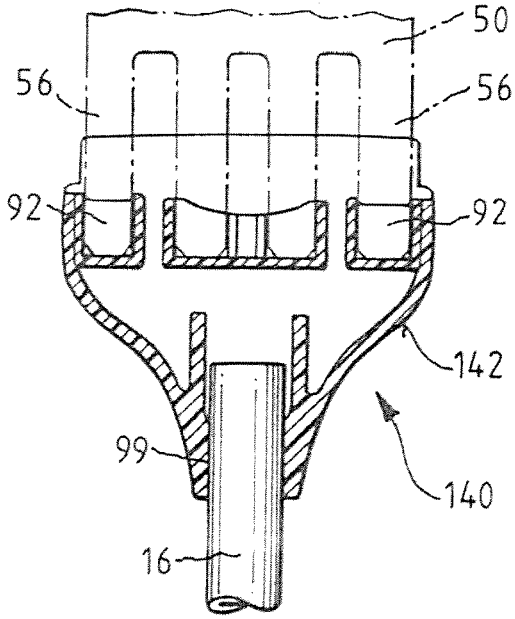
FIG. 10 is a cross-section substantially on the line 10-10 in FIG. 9.

FIGS. 5 to 10 illustrate an alternative form of deflector element 140 formed in accordance with the invention. In these Figures, like reference numerals denote like parts in FIGS. 1 to 4 and 11 to 18 and the following description is confined to differences between the deflector elements 14 and 140. In particular, the body 142 of the deflector element 140 has an extended generally flat portion 144 at one side, the other side being generally part-conical with an outer surface similar to surface 88*a* of the deflector element 14 (FIGS. 1 and 4). Portion 144 has, at its inner side, pockets 92 for receiving the contact portions 34. Portion 144 is positioned immediately outside the contact portions 34 of connector 10, when the deflector element is positioned for use in pulling through. In this configuration, an outer generally flat surface 146 on portion 144 lies substantially flush with an adjacent generally planar surface 150 (FIG. 5) of connector body 12, and the fingers 56 of the connector element 50 are, as in the case of the deflector element 14, received in pockets 92. FIG. 10 illustrates the manner in which fingers 56 of the connector element 50 fit into the pockets 92. In this figure, the connector element 50 is shown by phantom lines in the pockets 92. The deflector element 140 can, however, be moved to the position shown in FIG. 6, where generally flat portion 144, and surface 146, are in spaced generally parallel relationship to portion 34 of connector body 12.

Embodiments of the invention are useful as patch cord connectors, where the cable 16 is in the form of a patch cord. The patch cord may have connectors 10 at each end, for example.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that that prior art forms part of the common general knowledge in Australia.

The reference numerals in the claims are provided for ease of reference to the drawings and are not to be taken as limiting the claims to constructions where integers are identified by such reference numerals in the claims are necessarily limited to being formed as shown or described with reference to the drawings.

LIST OF COMPONENTS

10 Electrical Connector
12 Body (connector 10)
14 Deflector element
16 Electric cable
18 Upper part (of connector body 12)
20 Lower part (of connector body 12)
22 Snap fasteners with apertures and co-operating posts

24 Apertures (of snap fasteners 22)
26 Latching posts (of snap fasteners 22)
26*a* Cam surfaces (on latching posts 26)
26*b* Locking surfaces (on posts 24)
28 Inner planar surface (of portion 32 of connector body 12)
30 First bridging portion (of connector body 12)
32 Downwardly depending portion (of connector body 12)
34 Contact portions (of connector 10).
36 Cable receiving portion (of connector body 12)
38 Passageway (through cable receiving portion 36).
40 Spigot 40
42 Slot (in spigot 40)
44 Socket structure (on part 18)
46 Rectangular wall (of socket structure 44)
48 Socket (of socket structure 44)
49 Side (of connector 10)
50 Connector element
52 Insulative substrate (of connector element 50)
52*a* Inward steps (on substrate 52)
54 Insulation displacement contacts (of connector element 50)
55 First end portion (of connector element 50)
56 Fingers (on substrate 52)
57 Second end portion (of connector element 50)
58 Slots 58 (of insulation displacement contacts 54)
58*a* Entry portion (of slot 58)
60 Opposed portions (of IDCs 54 on connector element 50)
62 Conductive edge portions (on slots 58)
70 Insulated wires
72 Insulation (of wires 70)
74 Conductors (of wires 70)
76 Notches
78 Circuit tracks (on substrate 52)
80 Prongs
81 Annular conductive portions
82 Contacts
84 Body (of deflector element 14)
86 Entry portion (of body 84)
88 Upwardly divergent hollow portion (of body 84)
88*a* Deflector surface
92 Pockets (in deflector element 14)
93 Ledges (on inner side surfaces of casing part 20)
94 Central passageway (of deflector element 14)
95 Openings (in body portion 32)
97 Wall (of depending portion 32)
98 Planar side surface
99 Upper wall (of connector body part 12)
100 Connector module
104 Trough (module 100)
106 Side surface (module 100)
108 Upstanding posts (module 100)
112 IDCs
114 Contact portions
120 Contact members
122 Openings (in module 100)
140 Deflector element
142 Body (of deflector element 140)
144 Generally flat portion (of deflector element 140)
146 Outer generally flat surface (of portion 144)
150 Surface (on connector body 12)

The claims defining the invention are as follows:

1. A method of electrically connecting a plurality of insulated wires to a printed circuit board partially within a connector body, the insulated wires each including an inner conductor axially surrounded by insulation, the method comprising:

inserting the plurality of insulated wires into a corresponding plurality of notches of a socket structure within the connector body;

inserting an edge of a circuit board including a corresponding plurality of slots formed in the edge into the socket structure, each slot having a conductive edge electrically connected to a conductive track electrically connecting to an electrical contact at an opposite edge of the printed circuit board which protrudes from the connector body and sized to, upon receipt of the insulated wire when the edge of the circuit board is inserted into the socket structure, displace a portion of the insulation to establish electrical connection between the inner conductor of the insulated wire and the conductive edge of the slot, whereby inserting the insulated wire into the slot electrically connects the inner conductor to the at least one conductive track and the electrical contact, the electrical contact insertable into a trough of a connection module.

2. The method of claim 1, wherein each conductive track is disposed on a surface of the printed circuit board.

3. The method of claim 1, wherein the edge of the circuit board is aligned at an angle to the plurality of notches of the socket structure when inserting the edge of the circuit board into the socket structure.

4. The method of claim 1, wherein the conductive edge of each slot is disposed along the two opposing portions of the slot.

5. The method of claim 1, wherein the printed circuit board is at least partially formed from a laminar insulating material.

6. The method of claim 5, wherein the conductive edge of each slot is disposed on the laminar insulating material.

* * * * *